US006062948A

United States Patent [19]

Schiff et al.

[11] Patent Number: 6,062,948

[45] Date of Patent: May 16, 2000

[54] APPARATUS AND METHOD FOR GAUGING A WORKPIECE

[75] Inventors: Tod F. Schiff, Portland, Oreg.; Mark E. Southwood, Vancouver, Wash.; Michael J. Smith, Jerseyville; Michael J. Harms, Dow, both of Ill.

[73] Assignee: Schmitt Measurement Systems, Inc., Portland, Oreg.

[21] Appl. No.: 09/139,516

[22] Filed: Aug. 25, 1998

Related U.S. Application Data

[63] Continuation-in-part of application No. 08/844,727, Apr. 18, 1997, Pat. No. 5,800,247.

[60] Provisional application No. 60/015,670, Apr. 19, 1996.

[51] Int. Cl.[7] ..... B24B 49/00

[52] U.S. Cl. ..... 451/9; 451/6; 451/49; 356/371; 73/105

[58] Field of Search ..... 451/5, 6, 49; 356/371; 250/227, 359.11, 341.8, 359, 559.24; 73/105

[56] References Cited

U.S. PATENT DOCUMENTS

| | | | |
|---|---|---|---|
| 2,481,993 | 9/1949 | Fuss | 175/320 |
| 3,060,421 | 10/1962 | Rideout | 343/5 |
| 3,258,688 | 6/1966 | Augustine et al. | 324/58.5 |
| 3,490,037 | 1/1970 | Williams | 324/58.5 |
| 3,514,703 | 5/1970 | Soga | 324/58.5 |
| 3,749,500 | 7/1973 | Carlson et al. | 356/156 |
| 3,802,774 | 4/1974 | Eschler et al. | 356/4 |
| 3,897,156 | 7/1975 | Chasson | 356/157 |
| 4,045,727 | 8/1977 | Yu et al. | 324/58.5 |
| 4,053,237 | 10/1977 | Casey | 356/209 |
| 4,201,476 | 5/1980 | Musto et al. | 356/386 |
| 4,501,095 | 2/1985 | Drinkuth et al. | 51/165 |
| 4,503,327 | 3/1985 | Wilson | 250/261 |
| 4,509,295 | 4/1985 | Bottcher et al. | 51/49 |
| 4,623,835 | 11/1986 | Mehdizadeh et al. | 324/58.5 |
| 4,693,038 | 9/1987 | Vetter | 451/6 |
| 4,775,236 | 10/1988 | Cohen et al. | 356/387 |
| 4,854,707 | 8/1989 | Ring et al. | 356/356 |
| 4,880,991 | 11/1989 | Boehnlein et al. | 250/560 |
| 4,931,658 | 6/1990 | Tole | 250/560 |
| 4,991,308 | 2/1991 | Donaldson | 33/555.1 |
| 5,175,595 | 12/1992 | Fukase | 356/387 |
| 5,480,342 | 1/1996 | Bannayan et al. | 451/6 |
| 5,625,446 | 4/1997 | Bedard | 451/6 |
| 5,703,362 | 12/1997 | Devitt et al. | 250/339.11 |
| 5,717,210 | 2/1998 | Bexelius et al. | 250/341.8 |
| 5,746,644 | 5/1998 | Cheetham | 451/49 |
| 5,841,546 | 11/1998 | Carangelo et al. | 250/339.11 |

*Primary Examiner*—Robert A. Rose
*Assistant Examiner*—George Nguyen
*Attorney, Agent, or Firm*—Madson & Metcalf

[57] ABSTRACT

A gauging apparatus for use with a grinding machine performs dimensional measurements during machining of a workpiece. The gauging apparatus has a sensor head with a single sensor for performing proximity measurements of the workpiece. The sensor head further has vents adjacent to the sensor to vent air to clear working fluids and debris from between the sensor and the surface of the workpiece. A sensor head arm moves the sensor head in radial and tangential directions relative to the workpiece. A computer communicates with the sensor and the sensor head arm to determine, during the machining process, the relative position of the sensor head to the workpiece, the proximity of the sensor to the workpiece, the position of the workpiece, and the dimensions of the workpiece. The gauging apparatus is capable of performing measurements of the workpiece for initial positioning and for precision dimensional measurements. Computer control of the grinding machine allows for generation of a workpiece profile and adjustments in the machining of the workpiece until targeted results are achieved.

41 Claims, 11 Drawing Sheets

246
= Δ Z
208
130

246
= Δ Z
208
130

246
= Δ Z
208
130 y
z

APPARATUS AND METHOD FOR GAUGING A WORKPIECE

This application is a continuation-in-part of application Ser. No. 08/844,727, filed Apr. 18, 1997 now U.S. Pat. No. 5,800,247 which in turn is a conversion of Provisional application Ser. No. 60/015,670, filed Apr. 19, 1996, which applications are incorporated herein by reference.

BACKGROUND

1. The Field of the Invention

The invention is directed to an apparatus for gauging work pieces. More specifically the invention is directed toward non-contact gauging of work pieces during surface profile altering operations.

2. The Background Art

In manufacturing nominally circular parts it is necessary to make accurate quality assessments of the parts before, during, and after the manufacturing process. Such parts are often termed workpieces or rolls and are configured such that at least a portion of the part has a nominally circular geometric shape. Such workpieces may have the shape of a cylinder, cone, or have circularly symmetric parts of irregular axial cross section. A workpiece may have a crown portion, a concave portion, or a multiplicity of both. Workpieces range in sizes from two inches in diameter to several feet in diameter depending on the function or application of the workpiece. Workpieces have a wide variety of uses including use in rotating machinery such as in assembly line machinery or in turbines used in power generation or propulsion. In turbine applications, workpieces are used for cumbusters, turbine rotors, and turbine casings.

A workpiece is machined by applying a grinding wheel to a workpiece which is rotating about the longitudinal axis of the workpiece. The grinding wheel acts to reduce material on the workpiece to alter the surface and achieve a desired diameter. The grinding wheel is applied at different locations along the longitudinal axis of the workpiece to provide diameters dependent on the longitudinal position of the workpiece. In this manner, a workpiece is created with a specific shape. During grinding, a coolant or working fluid is applied to the workpiece to reduce heat damage to the workpiece due to frictional heat resulting from application of the grinding wheel.

For quality control and assessment, it is required in the fabrication process to accurately measure the diameters of the workpiece along a longitudinal axis of the workpiece. Diameter measurements of a workpiece provide direct information about the dimensions of the workpiece. Before machining a workpiece, it is necessary to perform diameter measurements in order to accurately apply the grinding wheel to obtain the desired results. During the machining process, it is necessary to conduct precision measurements to determine the current diameters to know when the desired shape has been achieved. Finally, after the machining process it is desirable to measure the shape of the workpiece as a record and to ensure quality control of the process.

Diameter measurements have been conventionally performed through the use of micrometers or calipers that encircle the workpiece so as to come into contact with opposite side surfaces of the workpiece. This process is difficult and time consuming in that it delays machining of the workpiece and requires the expertise of a skilled operator performing the measurement. Since mechanical surface contact is required for micrometers and calipers to work, slight fluctuations in surface texture introduce error in measurement. The operator of the micrometers of calipers must also be experienced with them in order to obtain accurate and repeatable measurements.

During grinding operations, contact gauges such as micrometers and calipers are in contact with the surface of the workpiece, to measure the workpiece diameter as it is being machined. The contact between the caliper and the roll results in wear and vibrations which limit the caliper's life. This limits the accuracy of the readings which in turn limits the accuracy of the grinding process. Further, the contours of the workpiece may make contact gauging instruments impossible to use due to the lack of positive engagement between the contacting surfaces of the instruments with the workpieces. A further disadvantage is that contact with the workpiece creates undue wear on the workpiece which cause deformities in the workpiece.

More sophisticated measurement methods suggest the use of non-contact gauging but often require elaborate systems employing several non-contact gauges to perform measurements. Non-contact gauging systems are fairly expensive in requiring several non-contact gauges which must operate in computer controlled operation with one another. Non-contact gauging systems often require substantial delays in setting up in order to provide accurate measurements. Such systems may further require experienced operators to provide accurate placement of the non-contact gauges and to correctly interpret the results. Non-contact gauging systems often do not disclose how the non-contact gauge is initially positioned relative to workpieces of various sizes and how working fluids are prevented from interfering with the measurements.

Several non-contact gauging systems incorporate conventional laser sensors and use a system of lenses and mirrors in the path of the laser beam. Lenses and mirrors have inherent imperfections and the resulting measurements will be in error to the extent of the imperfections. These imperfections result when the mirrors or lenses are placed between the laser light source and the workpiece. When the beam reflects from a mirror or passes through a lens, the beam takes a path which is altered from its ideal path. This is due to the imperfections inherent in all lenses and mirrors. The imperfectly directed beam can strike the workpiece when it should pass by and be detected. This leads to the computer calculating a measurement based on a false edge of the workpiece. When these imperfections are introduced in the path of the beam prior to the beam contacting the object being measured, significant error is introduced into the measuring device.

Thus, it would be an advancement in the art to provide a non-contact gauging system for use in surface profile altering devices for precision machining of workpieces. It would be an additional advancement in the art to provide a non-contact gauging system which can be rapidly and accurately positioned for reliable, nondestructive, and accurate measurements. It would be a further advancement in the art to provide a non-contact gauging system which is relatively inexpensive to perform measurements before, during, and after the process of machining a workpiece to provide dimensions of the workpiece.

BRIEF SUMMARY

The invention is directed towards a gauging apparatus to be used in conjunction with a grinding machine for performing dimensional measurements before, during, and after machining of a workpiece. Measurements of the workpiece are performed while the workpiece is mounted in the grinding machine and may be performed while the workpiece is rotating about its longitudinal axis.

The gauging apparatus comprises a sensor head having a single sensor. The sensor may be a contact or non-contact sensor and is used to determine the proximity of a workpiece relative to the sensor. In one presently preferred embodiment, the gauging apparatus incorporates a non-contact sensor to perform proximity measurements without contacting the surface of the workpiece. A non-contact sensor enjoys the benefits of increased speed in measuring, superior accuracy, and reduced wear on the workpiece.

The sensor head is further equipped with air vents adjacent to the sensor and configured to vent air to clear working fluids and debris from between the sensor and the surface of the workpiece. Removal of interfering materials provides superior accuracy in measuring by the sensor.

The gauging apparatus further comprises a sensor head arm connected to the sensor head for moving the sensor head in radial and tangential directions relative to the workpiece. Two dimensional movement allows for surface measurements of the workpiece at a position on the longitudinal axis.

During the machining process, the grinding machine will typically move the workpiece along the longitudinal axis. A longitudinal axis detector is included to generate signals indicative of the position of the sensor relative to the workpiece in the longitudinal axial direction.

The gauging apparatus incorporates a computer which is in electrical communication with the sensor, sensor head arm, and the longitudinal axis detector. The computer controls movement of the sensor head and the sensor head arm relative to the workpiece. In one presently preferred embodiment, this is accomplished by the computer sending signals to the sensor head arm to indicate coordinate positions to which the sensor head arm is to move. In response, the sensor head arm moves to the given coordinates. Position of the sensor head is thus known by the computer which preestablishes the destination location.

The gauging apparatus is capable of performing measurements on the workpiece for initial positioning and for precision dimensional measurements. In one presently preferred embodiment, this is achieved by directing the sensor to the surface of the workpiece at a plurality of locations having substantially the same longitudinal position along the longitudinal axis of the workpiece. The distances to the workpiece at each of the longitudinal positions are measured by the sensor to determine the highest point of the workpiece relative to the sensor or zenith.

Once the location of the zenith is established, proximity measurements are performed to determine the diameter of the workpiece. The computer is informed of the proximity of the sensor to the workpiece by receiving signals from the sensor which are indicative of the distance. The computer is further informed of the longitudinal position of the workpiece relative to the sensor by receiving signals from the longitudinal axis detector. Based on the proximity of the sensor to the workpiece at different tangential positions, the computer performs geometrical calculations to deduce the diameter at a longitudinal position. Determining diameters of the workpiece along the longitudinal length of the workpiece allows the computer to determine a profile of the workpiece.

Performing dimensional measurements prior to machining informs an operator as to the state of the workpiece. Based on this information, the operator is able to determine necessary machining to achieve target dimensions. Computer monitoring of the workpiece during the grinding process allows for adjustments in the machining of the workpiece until the target dimensions are achieved. Adjustments in machining may be performed manually by an operator or may be done through computer control of the grinding machine. Upon completion, dimensional measurements may be taken to ensure that the workpiece complies with the target dimensions and to produce a final record of the results.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide selected embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference is now made to the embodiments and methods illustrated in FIGS. 1 through 10. A three axis Cartesian coordinate system with reference to a workpiece will be used in describing the invention. The "x-axis" refers to the lateral direction or longitudinal direction of a workpiece. The "y-axis" refers to the front to rear axis of the workpiece.

The "z-axis" refers to the vertical direction. Positive directions are referenced as being right, forward, and down, respectively, as is customary in geometry.

Figure 2:
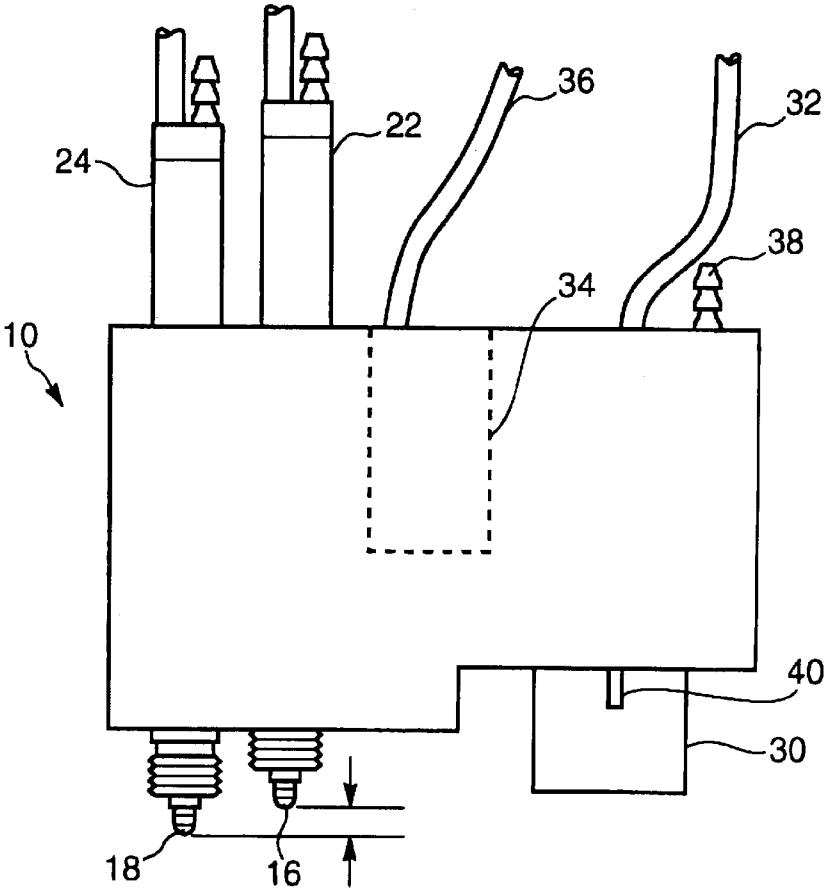
FIG. 2 is a front view of the sensor head of FIG. 1.
Figure 1:
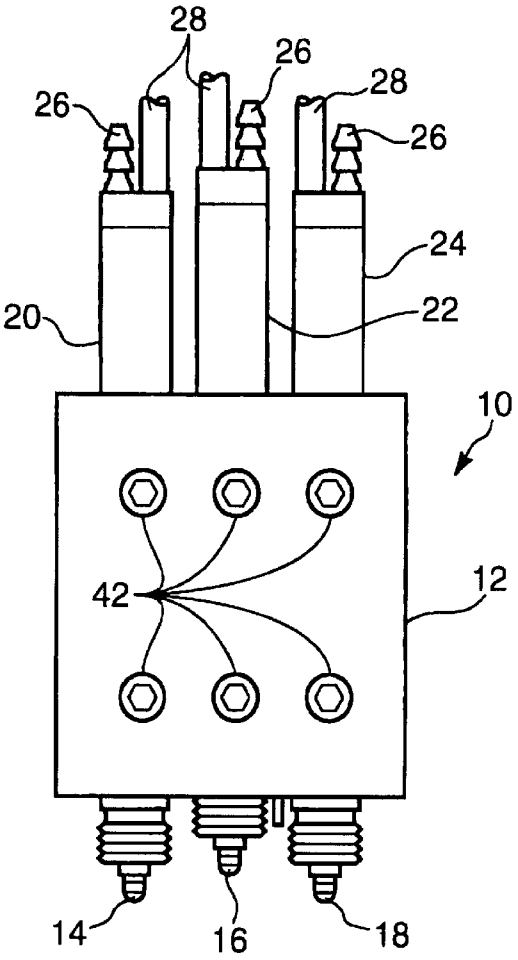
FIG. 1 is a right side view of the sensor head.

With reference to FIGS. 1 and 2, a sensor head 10 of the non-contact gauging system is shown. The sensor head 10 comprises a sensor head body 12 for containing the components of the sensor head 10. The sensor head 10 further comprises front, center and rear contact probes 14, 16, 18. In one presently preferred embodiment, the contact probes 14, 16, 18 are Solartron Model PDP probes available commercially from Solartron Metrology of Buffalo, N.Y. Such contact probes are capable of measuring at the rate of 240 measurement per second.

Each contact probe 14, 16, 18 has a respective sensor connector 20, 22, 24 leading therefrom. Sensor connectors 20, 22, 24 each contain a pneumatic inlet 26 and an electrical lead 28. The electrical leads 28 connect to a computer which is described in greater detail below. The front and rear probes 14, 18 are aligned along the y-axis of the sensor head 10, while the center sensor 16 is offset in the +x direction of a non-contact sensor 30. The three contact probes 14, 16, 18 are extendible in response to pneumatic pressure in inlet 26 and provide linear position information in the form of signals through electrical leads 28.

The sensor head 10 further comprises a non-contact sensor 30. In one presently preferred embodiment, the non-contact sensor 30 is a reflected light distance measuring device such as is available commercially from Philtech, Inc. of Annapolis, Md. and which has a resolution of up to one microinch. However, one of skill in the art will appreciate that a variety of non-contact sensors are suitable and are included within the scope of the invention. A non-contact sensor lead 32 is in electrical communication with the non-contact sensor 30 to relay signals to and from the non-contact sensor 32.

The sensor head 10 further comprises a proximity sensor 34 which serves to sense the proximity of the workpiece and maintain a distance from the sensor head 10 and the workpiece 130 during non-contact gauging. Proximity sensors 34 are well known in the art and any one of a variety of proximity sensors may be incorporated into the invention. A sensor lead 36 is in electrical communication with the proximity sensor 34 to place the proximity sensor 34 in electrical communication with other components of the invention such as the computer which is described below The sensor head 10 includes an air inlet 38 and an air outlet 40. The air inlet 38 and air outlet 40 serve to allow air to be directed against the surface of a workpiece being measured. This is to clear working fluids and debris from in front of the non-contact sensor 30 to minimize the effects, if any, of the working fluid and debris upon the measurements made by the non-contact sensor 30. The outlet 40 is preferably placed on the y-axis of the sensor head 10 immediately in front of the non-contact sensor 30. However, one of skill in the art will appreciate that other locations might prove equally effective in practice, and thus could be substituted.

The embodiment of FIG. 1 displays optional locking bolts 42 which allow access to the interior of the sensor head body 12. This is to allow access for maintenance and removal of the contact probes 14, 16, 18 as needed.

Figure 4:
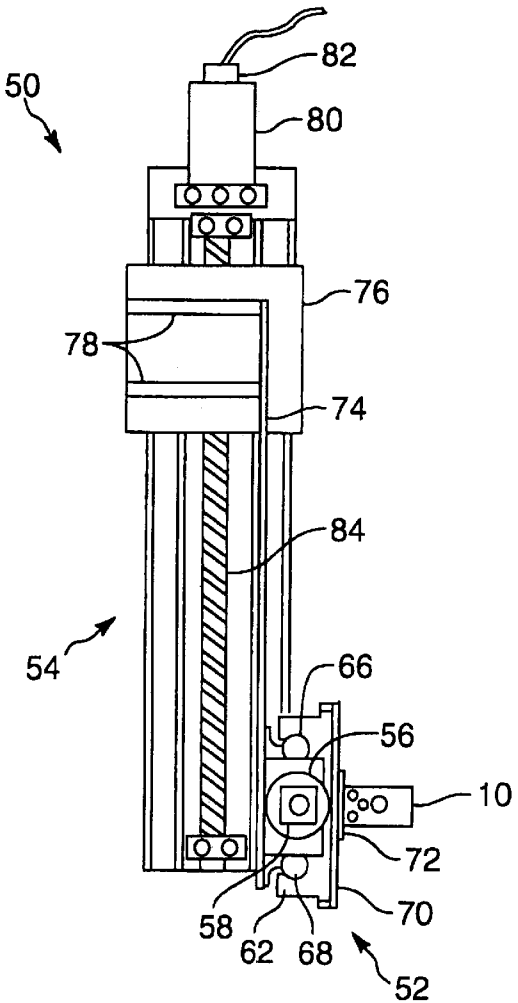
FIG. 4 is a top view of the sensor arm of FIG. 1.
Figure 3:
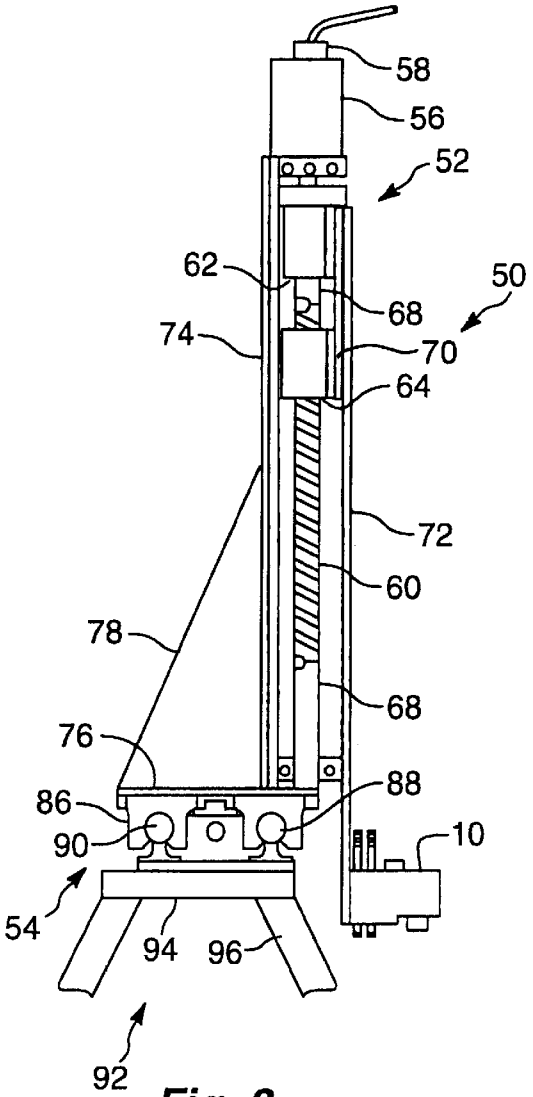
FIG. 3 is a front elevational view of a sensor arm embodying a preferred form of the invention.

With reference to FIGS. 3 and 4, one possible embodiment of the sensor arm 50 of the non-contact gauging system is shown. The sensor arm 50 comprises a vertical rail drive 52 and a horizontal rail drive 54. FIG. 3 illustrates a front view of the sensor arm 50 displaying the vertical rail drive 52 extending vertically from the horizontal rail drive 54. FIG. 4 illustrates a top view of the sensor arm 50 displaying the length of the horizontal rail drive 54 and a top view of the vertical rail drive 52.

The vertical rail drive 52 comprises a servo motor 56 and a rotary encoder 58 which are in electrical communication with one another. The rotary encoder 58 controls operation of the servo motor 56. In one presently preferred embodiment, the rotary encoder 58 has a resolution of 4,096 pulses per revolution. The vertical rail drive 52 further comprises a ball screw 60 which is mechanically connected to the servo motor 56 to allow rotation of the ball screw 60. In one presently preferred embodiment, the ball screw 60 has a lead of 0.1" per revolution. Thus, for each electronic pulse from the rotary encoder 58 there is a linear, vertical movement of 0.0000244". One of skill in the art will appreciate that rotary encoders of various resolutions and ball screws of various leads may be incorporated into the present invention.

The vertical rail drive 52 further comprises a follower 62 and a nut 64 which both engage the ball screw 60. In an alternative embodiment, the follower 62 and the nut 64 may be integrated into a single element. Rotation of the ball screw 60 effects vertical movement of the follower 62 and the nut 64. The vertical rail drive 52 further comprises a pair of vertical rails 66, 68 to which the follower 62 and the nut 64 are slidably connected. In FIG. 3, vertical rail 68 is shown partially cut away in order to show the location of the ball screw 60.

The follower 62 and nut 64 are both rigidly attached to a vertical platform 70. A vertical bar 72 is in turn rigidly attached to the vertical platform 70. The sensor head 10 is rigidly attached to the vertical bar 72. Movement of the follower 62 and the nut 64 together act to move the vertical platform 70, vertical bar 72, and the sensor head 10 up or down depending on the direction that the ball screw 60 is rotated. In this manner, vertical movement of the sensor head 10 is effected.

The vertical rails 66, 68 are rigidly attached to a support plate 74 to thereby mount the vertical rail drive 52 to the support plate 74. The support plate 74 is rigidly connected to a platform 76. Lateral vertical support plates 78 are rigidly connected to both support plate 74 and platform 76 to ensure the fixed relationship of the support plate 74 to the platform 76.

As with the vertical rail drive 52, the horizontal rail drive 54 comprises a servo motor 80 and a rotary encoder 82 which are in electrical communication with one another. The horizontal rail drive 54 further comprises a ball screw 84 which is mechanically connected to the servo motor 80. The horizontal rail drive 54 further comprises a follower 86 which engages the ball screw 84. Rotation of the ball screw 84 causes horizontal movement of the follower 86. The follower 86 is slidably connected to a pair of horizontal rails 88, 90 to guide and support the linear movement of the follower 86. The follower 86 is rigidly attached to the platform 76. Thus, horizontal movement of the follower 86 results in horizontal movement of the platform 76, the vertical rail drive 52, and the sensor head 10. In this manner, the horizontal rail drive 54 causes forward and backward movement of the sensor head 10.

The sensor arm 50 is supported by a support stand 92 which is illustrated in FIG. 3. The support stand 92 is sized and constructed suitably for attachment to a grinding machine or other machine with which the non-contact gauging system is to be used. The shape and size of the support stand 92 is designed as needed to fit that particular machine. The support stand 92 includes a horizontal platform 94 which is secured to and supported by a suitable number of legs 96. The horizontal rail drive 54 is mounted upon the horizontal platform 94.

Figure 5:
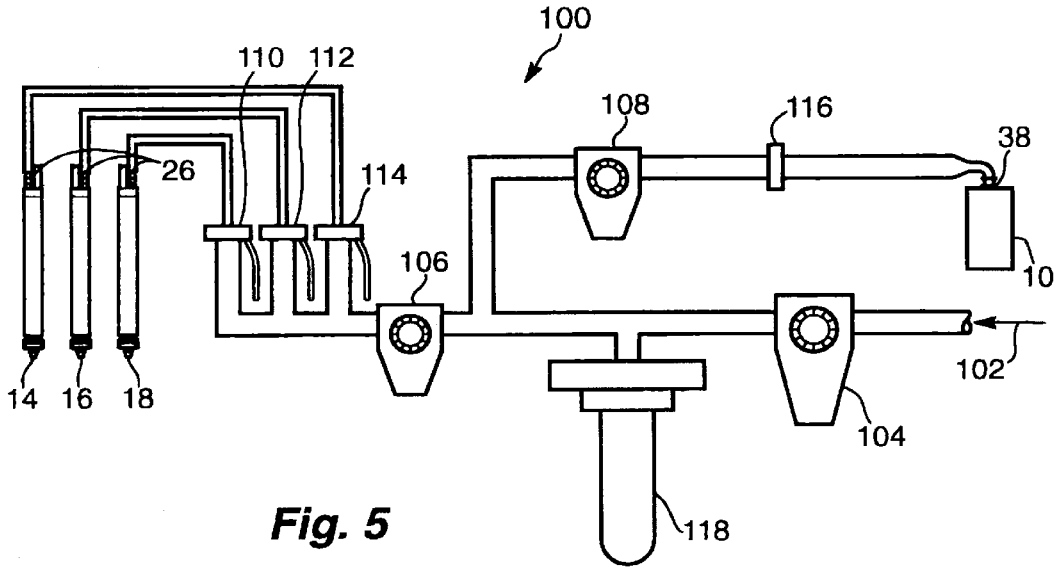
FIG. 5 is a schematic representation of pneumatic system used to control the sensor arm of FIG. 1.

With reference to FIG. 5, the pneumatic system 100 of the sensor arm 50 is illustrated. Pneumatic system 100 comprises an air supply 102 and a series of connecting passageways. The pneumatic system 100 further comprises a main regulator 104 which sets the overall pressure of the pneumatic system 100.

A secondary regulator 106 sets the pressure of the air supply to the three contact probes 14, 16, 18 to allow extension and retraction of the probes 14, 16, 18. An additional secondary regulator 108 sets the pressure to the air inlet 38 of the sensor head 10. The pressure to the air inlet 38 is used to clear working fluids and debris from the surface of the workpiece and may be different than air pressure to the contact probes 14, 16, 18.

The pneumatic system 100 comprises four solenoid valves 110, 112, 114, 116. The air supply 102 to the contact probes 14, 16, 18 and the air inlet 38 can be individually turned on or off by solenoid valves 110, 112, 114, 116 as appropriate to operation of the system 100. The pneumatic system 100 further comprises an air dryer 118 to reduce humidity in the system 100.

Figure 6:
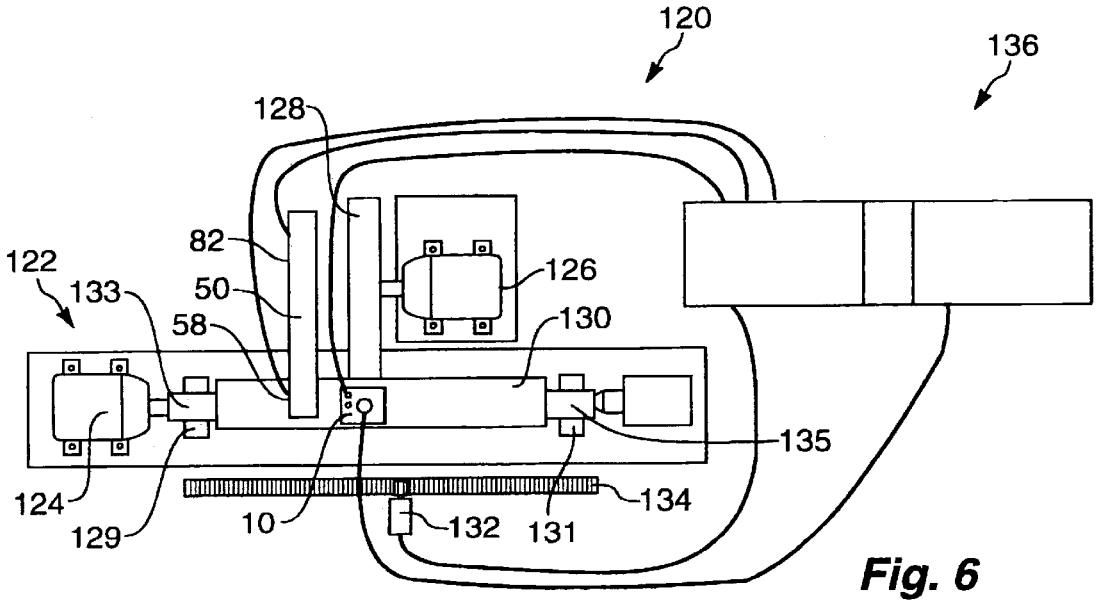
FIG. 6 is a diagram of the electrical connections of the sensor arm of FIG. 1 and an encoder rack with a computer.

With reference to FIG. 6, the non-contact gauging system of the present invention is generally shown and designated 120. Also shown in FIG. 6 is a conventional grinding machine 122 which is used in conjunction with the non-contact gauging system 120 of the present invention. The grinding machine 122 comprises motors 124, 126 which control the operation of the grinding machine 122 and grinding wheel 128, respectively. The grinding machine 122 is not part of the invention but is shown as an exemplary machine with which the non-contact gauging system 120 could be advantageously used. The grinding machine 102 comprises journal rests 129, 131 for placement of journals connected to a workpiece.

FIG. 6 further illustrates a workpiece 130 which is mounted in the grinding machine 122. The workpiece 130 may be any number of various nominally circular geometric shaped parts which are machined for various industrial purposes. Such workpieces may have the general shape of a cylinder, cone, or have circularly symmetric parts of irregular axial cross section. The non-contact gauging system 120 is used to increase the accuracy and reliability of the measurement of the workpiece 130 before, during, and after machining. The workpiece 104 is connected to journals 133, 135 as is common in the practice. The journals 133, 135 are mounted to the journal rests 129, 131.

The non-contact gauging system 120 comprises the sensor head 10 which is the operative device for performing measurements of the surface of the workpiece 130. The sensor head 10 is in connection with the sensor arm 50 for moving the sensor head 10 in tangential and radial (z and x axis) directions relative to the workpiece 130.

The non-contact gauging system 120 further comprises a longitudinal encoder 132 for movement along the x-axis. The non-contact gauging system 120 further includes a rack 134 to allow the system 120 to know its location along the longitudinal or x-axis of the workpiece 130. In one presently preferred embodiment, a gear with a pitch of 1.987" is suitable for the longitudinal encoder 132 and rack 134. In one embodiment, the longitudinal encoder 132 may have a resolution of 256 pulses per revolution, or 0.0242" per pulse.

The non-contact gauging system 120 further comprises a programmable computer 136 which is in electrical communication with the sensor head 10, the sensor head arm 50, and the longitudinal encoder 132. The programmable computer 136 is connected to the rotary encoder 58 of the vertical rail drive 52 and the rotary encoder 82 of the horizontal rail drive 54 to control y-axis and z-axis movement of the sensor head 10.

The computer 136 is in electrical communication with the contact probes 14, 16, 18, the proximity sensor 36, and the non-contact sensor 30 of the sensor head 10. The computer 136 is further in electrical communication with the solenoid valves 110, 112, 114, 116 of the pneumatic system 100. The computer 136 is also in electrical communication with the longitudinal encoder 132.

Figure 7:
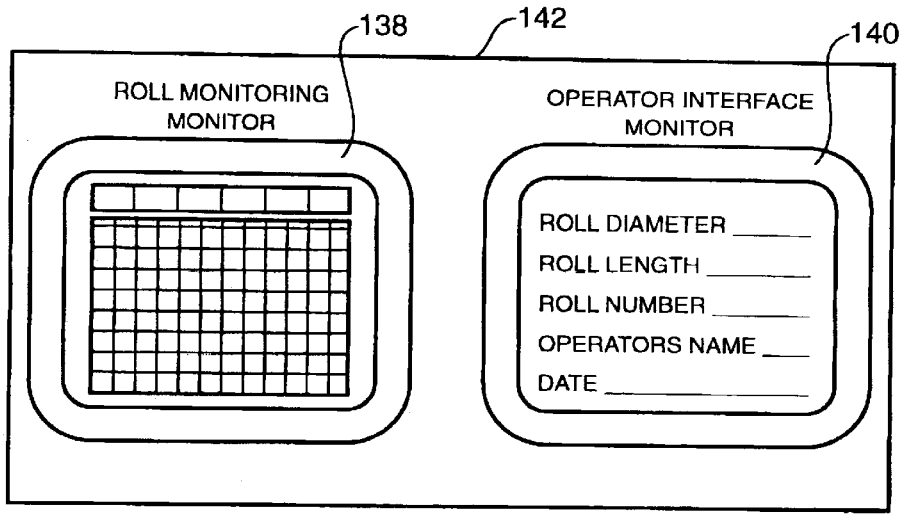
FIG. 7 is a view of a typical computer console of the non-contact gauging system of the invention.

With reference to FIG. 7, the input and output data from the computer 136 is shown on a computer monitor such as computer monitors 138, 140 of console 142. Monitor 138 is one example of a workpiece profile as calculated by the computer 136 from the sensor input information. Monitor 140 shows data input by the operator. In operation, a single computer monitor could be used with suitable programming to allow switching between images, or with suitable programming to allow windows showing the input data and calculated data without having to switch images. Such display technology is readily available with routine conventional programming.

Figure 8:
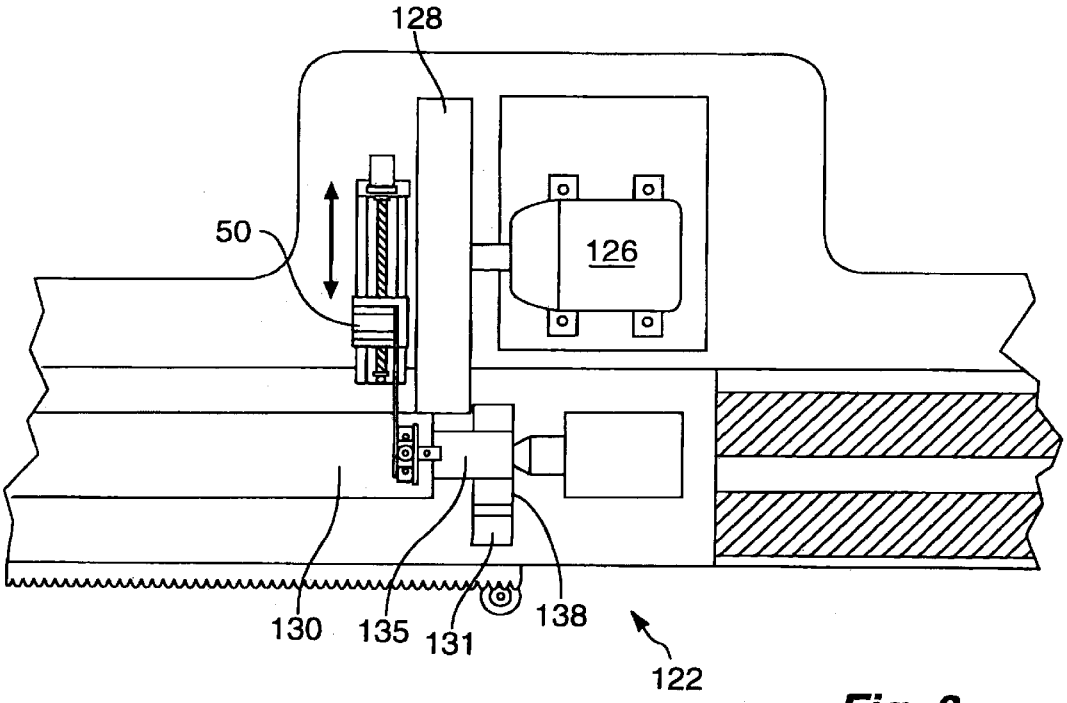
FIG. 8 is a top view of the sensor arm of FIG. 1 on a grinding machine in a position to determine the location of the right end of a roll to be ground therein.

With reference to FIG. 8, a view of the sensor arm 50 is shown on the grinding machine 122. The sensor arm 50 is shown positioning the sensor head 10 to determine the location of the zenith on the right end of the workpiece 130.

Use of the non-contact gauging system 100 is now explained. An operator will place a workpiece 130 in the grinding machine 122. The workpiece 130 is connected to journals 133, 135 which are positioned in journal rests 129, 131 as is common in the practice.

Figure 9:
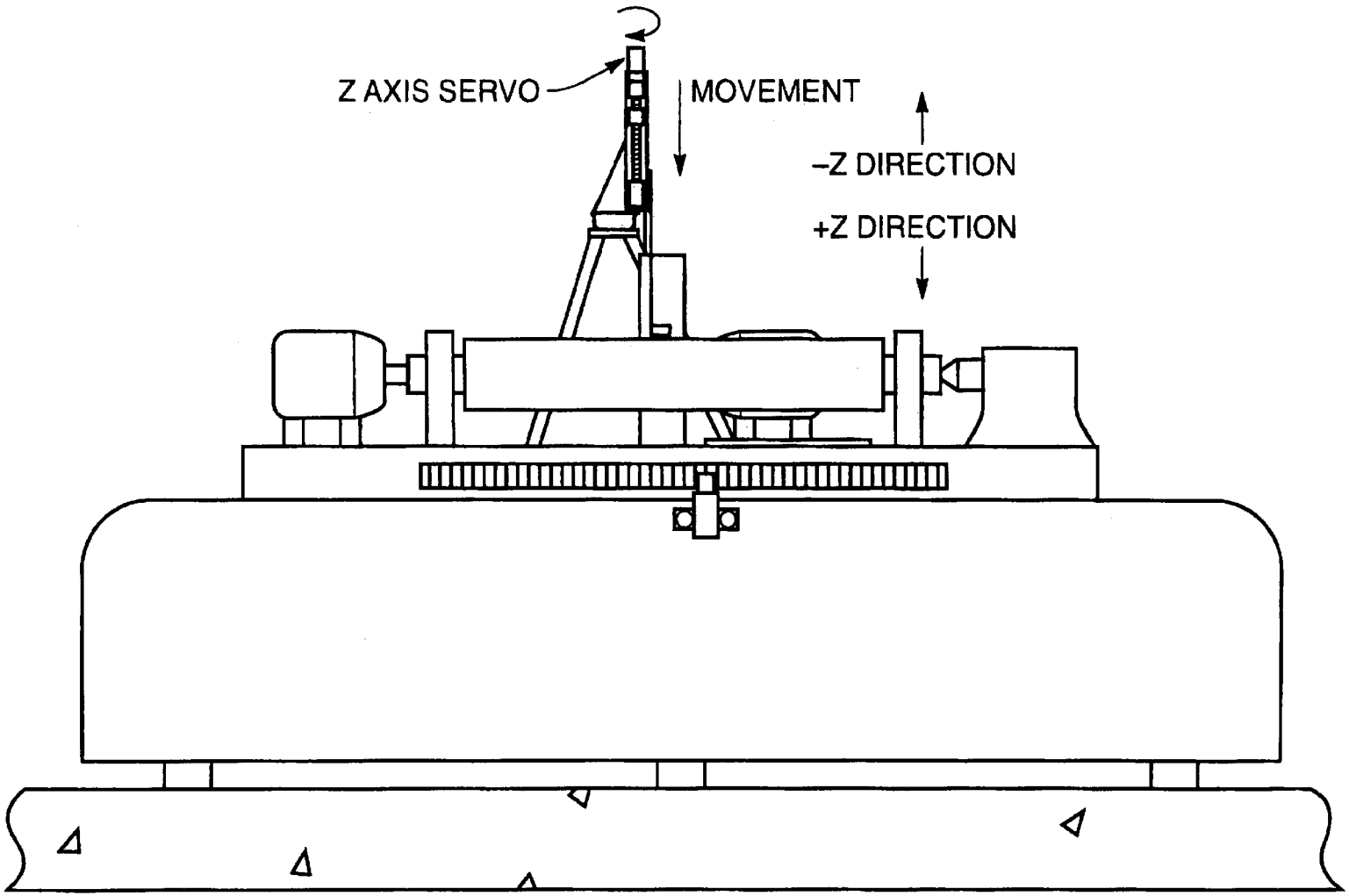
FIG. 9 is front elevational view of the sensor arm of FIG. 1 on the grinding machine of FIG. 8 in a position to locate the centerline or zenith of the roll to be ground.

The operator inputs into the computer 136 the size of the workpiece 130, such as 4.5000" diameter, 48" long (or other length and diameter). Based on the input, the computer knows approximately where in the y-axis and the z-axis to position the sensor head 10. The servo motors 56, 80 of the vertical rail drive 52 and the horizontal rail drive 54 are instructed by the computer 136 as to where to position the sensor head 10. An example of z-axis placement is shown in FIG. 9.

Figure 10C:
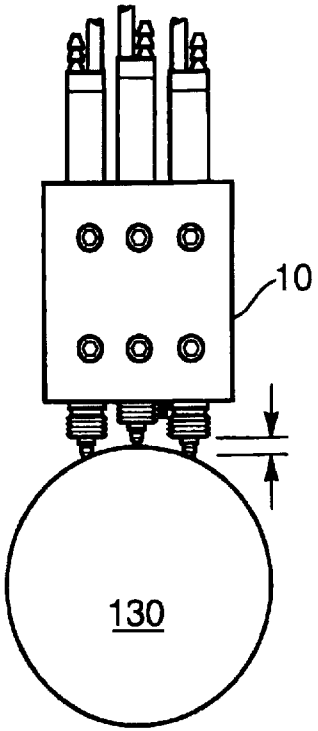
FIGS. 10, 10*a*, 10*b*, and 10*c* are side views of the sensor head of FIG. 1, in each of a series of four sequential positions used in determining the centerline and diameter of a roll to be ground.
Figure 10B:
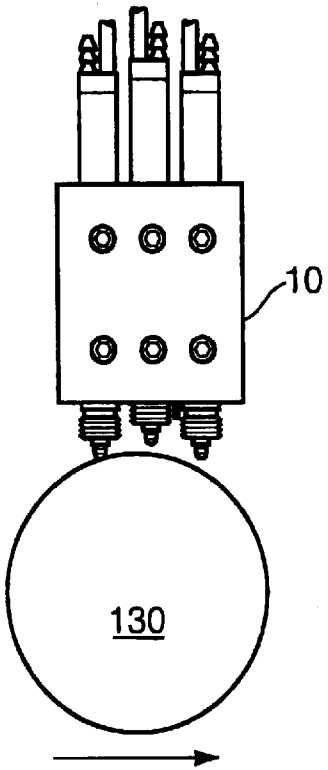
Figure 10A:
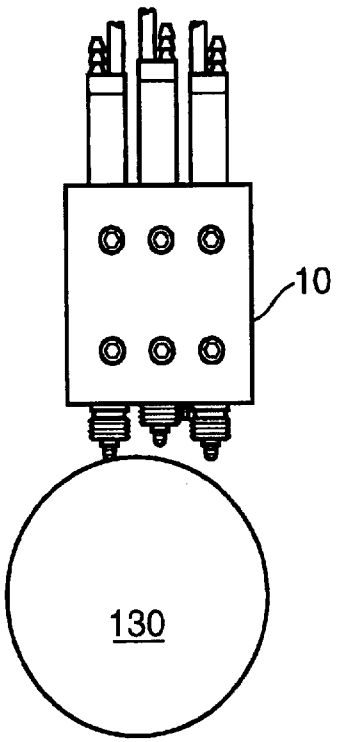
Figure 10:
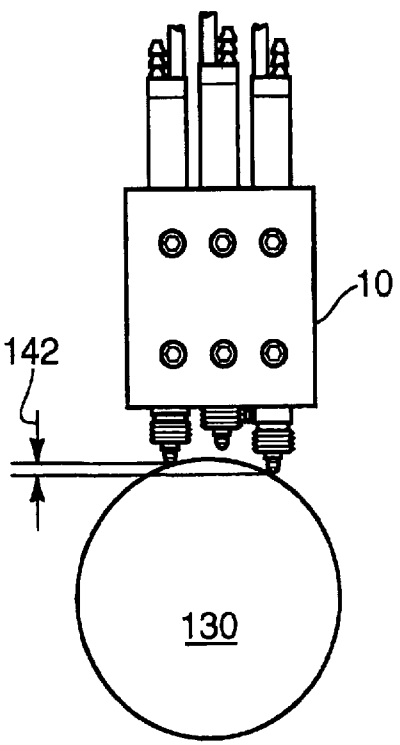

With reference to FIGS. 10A, B, C, and D, initial positioning of the sensor head 10 relative to the workpiece 130 is shown. In one presently preferred method, the sensor head 10 is placed approximately 0.15" from the theoretical zenith of the upper surface of the workpiece 130 adjacent one end of the workpiece 130. Non-contact probes 14, 18 travel vertically down to "feel" the upper surface of the workpiece 130 adjacent one end of the workpiece 130. If contact is not established, the sensor head 10 is moved an additional 0.05" in the −z direction (down) and non-contact probes 14 and 18 extend again. This is repeated until contact with the workpiece 130 is established.

The sensor head 10 adjusts itself in the manner shown in FIGS. 10A, B, C, and D horizontally so that the middle contact gauge 16 is at the zenith of the workpiece 130 at that end of the workpiece 130. This is done by measuring the "delta z" 142 between non-contact probes 14, 18, retracting the non-contact probes 14, 18, moving the sensor head 10 a calculated distance in the ±y direction toward the non-contact probe 30 measuring a higher surface (smaller probe length). The non-contact probes 14, 18 extend again, remeasure, and again move the sensor head 10 in the ±y direction toward the non-contact probe measuring a higher surface (smaller probe length). The process repeats until the non-contact probes 14, 18 measure equal length.

Measurements of the zenith are performed at both ends of the workpiece 130 to ensure that it is properly aligned in the grinding machine 122. Correction to the alignment is done by adjusting the position of the journal rests 129, 131. If the initial centering of probe 16 is over the right end, then adjustments may be made at the left end to the journal rest 129 to properly align the workpiece 130. Adjustments are made at the left end to move the journal 133 towards the shorter of the contact probes 14, 18. If contact probes 14, 18 are equal distant, then no alignment adjustment is necessary. Adjustments may be made either manually by an adjustment screw or, in a complete closed loop system, via servo motors similar to those already described for moving the sensor head 10.

The non-contact gauging system 120 then performs diameter measurements along the longitudinal length of the workpiece 130. This is done by contact probes 14, 16, 18 extending and contacting the surface of the workpiece 130 at a particular location along the longitudinal axis of the workpiece 130. The computer 136 then computes the diameter of the workpiece 130 based on a 3 dimensional Cartesian coordinate system in space. The system 120 then takes diameter measurements along the longitudinal axis of the workpiece 130 at preset intervals until the entire length of the longitudinal axis is reached. Next, the system 120 moves to the maximum diameter location of the workpiece 130. Contact probes 14, 16 retract and contact probe 18 extends and takes a measurement. Servo motor 56 adjusts the sensor head 10 so that the contact probe 18 is exactly 0.0200" from the zenith of the workpiece 130.

The non-contact sensor 30 then descends to the zenith of the workpiece 130, stopping approximately 0.0200" from the surface of the workpiece 130. The non-contact sensor 30 is calibrated by taking readings at predetermined distances from the zenith of the workpiece 130. The non-contact sensor 30 is then placed 0.0200" from the workpiece 130. Solenoid 116 is then activated to allow air from air supply 102 to flow through the non-contact sensor 30 to clear working fluids and debris. Coolant is turned on and the machining process begins. The non-contact sensor 30 is positioned in the same plane that the center of the grinding wheel 128 is located.

The computer 136 knows the initial workpiece diameter, the theoretical center of the workpiece 130, and the offset distance of the sensor head 10 as 0.0200" from the workpiece 130. This allows the non-contact sensor 30 to detect how much material is being removed from the workpiece 130 as the workpiece 130 surface "moves" away from the sensor head 10 because of the grinding process. Thus, the computer 136 knows during the machining process the diameter of the workpiece 130 and the shape profile of the workpiece 130 without contacting the workpiece 130 during the grinding process. The final workpiece 130 profile is stored in a memory of the computer 136, and a plot of the workpiece 130 profile can be printed on paper along with any other pertinent information.

Figure 11:
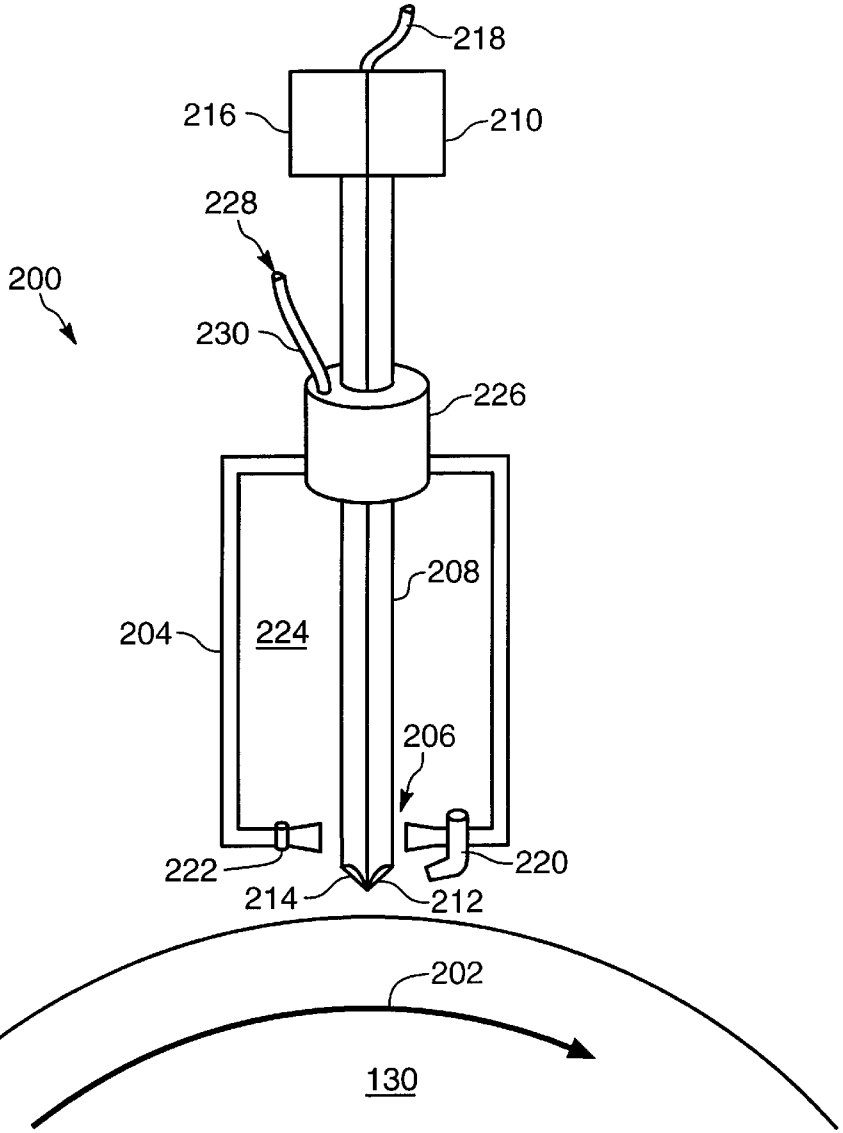
FIG. 11 is a cut-away side view of an alternative embodiment of the sensor head.

With reference to FIG. 11, an alternative embodiment of invention is described wherein the sensor head is generally designated as 200. FIG. 11 is a side view of the sensor head 200 as it is positioned above the workpiece 130. The workpiece 130 may be any cylindrical or non-cylindrical object having a longitudinal axis as previously described. The workpiece 130 is mounted in a conventional grinding machine 122 and the arrow 202 indicates the direction of rotation.

The sensor head 200 comprises a sensor head housing 204 for supporting and containing the elements of the sensor head 200. The sensor head housing 204 is configured with an aperture 206 which provides an opening for performing measurements..

The sensor head 200 further comprises a sensor 208. The sensor 208 is disposed such that it partially extends through the aperture 206 at the lower portion of the sensor head housing 206 as shown in FIG. 11. The sensor 208 serves to provide the proximity of the sensor head 200 to the workpiece 130 as linear position information in the form of signals. The sensor 208 further provides signals indicative of the dimensions of the workpiece 130. The sensor 208 may be a contact gauge such as those previously disclosed herein or it may be a non-contact gauge such as those utilizing light or microwave reflection.

In one presently preferred embodiment, as shown in FIG. 11, the sensor 208 is a reflected light distance measuring device which may utilize visible or non-visible light. Such devices are commonly known and rely upon operations of scatter and reflectance of light to perform distance measurements. In one embodiment, the sensor 208 is a 670 laser diode optical probe which is known in the art. One of skill in the art will appreciate that other forms of optical gauges may also be suitable and are included within the scope of the invention. A light sensor has the advantage of superior measuring speed, accuracy, and reduced wear to the workpiece 130 due to non-contact. All of these advantages enhance the efficiency of machining and measuring a workpiece 130 to achieve the desired dimensions. Using a light sensor assumes that the workpiece 130 has a reflectance which is the case for almost all workpieces 130.

In the embodiment shown in FIG. 11, the light sensor 208 is configured with a light source 210 which produces a light. The light is delivered and emitted by an outlet 212, such as a fiber optic, to contact the workpiece 130. The light sensor 208 is further configured with an inlet 214, such as a fiber optic, to receive a portion of the reflected light from the workpiece 130. The portion of the reflected light is delivered by the inlet 214 to a detector 216 to determine the proximity of the workpiece 130. Proximity of the workpiece 130 may be determined based on the intensity and position of the reflected light. In one embodiment, the outlet 212 directs the light at a certain angle relative to the workpiece 130 and the inlet 214 receives the reflected light at another angle. Based on the triangulation of the emitted and reflected light a determination of position may be made. In one presently preferred embodiment, both intensity and position of the reflected light are used to determine proximity. The detector 216 generates a signal indicative of the proximity of the workpiece 130. The light sensor 208 further comprises a sensor lead 218 which serves to receive power to enable the light source 210. The sensor lead 218 also provides electrical communication to deliver signals from the detector 216 to other components of the invention, such as the computer as discussed below.

The embodiment of FIG. 11 has the advantage of incorporating a single sensor 208 to perform proximity measurements and dimensional measurements of the workpiece 130. This is advantageous in requiring fewer components for fabrication and calibration and simplifying the process of measuring the workpiece 130 before, during, and after machining. The process of measuring the workpiece 130 by use of a single sensor 208 is described elsewhere below.

The sensor head 200 further comprises a first air vent 220 or "air knife." In operation, a coolant or working fluid is used to reduce resulting heat from the grinding of the workpiece 130. The coolant interferes with the measurements performed by the sensor 208. The first air vent 220 serves to blow air against the workpiece 130 to remove the coolant from between the sensor 208 and the workpiece 130. This serves to minimize the effects, if any, of the coolant upon the measurements made by the sensor 208. The first vent 220 is configured to vent air in an opposing direction to the rotation of the workpiece 130. In one presently preferred embodiment, the first vent 220 is configured as a tube which extends from the lower portion of the sensor head housing 204 and then bends to direct air in a direction opposing the rotation of the workpiece 130.

In one embodiment, the sensor head 200 may further comprise a second vent 222 which is disposed on the lower portion of the sensor head housing 208 substantially in line with the first vent 220 and the sensor 208 with the sensor 208 disposed therebetween. The second vent 222 may be simply embodied as a duct for air passage in the sensor head housing 204. The second vent 222 serves to assist the first vent 220 in the removal of coolant from the site of the sensor 208. The second vent 222 is an optional feature which may or may not be incorporated into the sensor head 200 of the present invention.

The sensor head 200 further comprises an interior cavity which serves as a positive pressure chamber 224 which is defined in part by the sensor head housing 204. The positive pressure chamber 224 is in connection with the first and second vents 220, 222 and supplies air to both. The sensor head 200 further comprises an air inlet 226 which is in connection with the positive pressure chamber 224. In operation, the air inlet 226 delivers sufficient air to the positive pressure chamber 224 to maintain a desired and consistent pressurized flow of air to the first and second vents 220, 222. If the aperture 206 provides sufficient space around the light sensor 208, then a pressurized flow of air may exit from the aperture 206 as well. An air stream from the aperture 206 would further assist the removal of working fluids and debris from between the light sensor 208 and the workpiece 130.

In one presently preferred embodiment, the air inlet 226 partially surrounds the sensor 208 such that the sensor 208 extends out of the air inlet 226 through the positive pressure chamber 224 and the lower portion of the housing 204 as shown in FIG. 11. Alternatively, the air inlet 226 may be connected independently and separately to the positive pressure chamber 224. An air source 228 delivers air through an inlet hose 230 to the air inlet 226 to provide a supply of air as needed.

Figure 12:
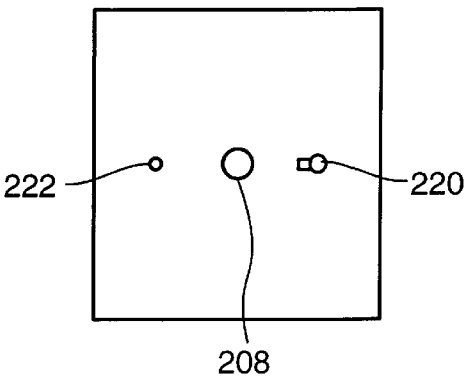
FIG. 12 is a bottom view of the sensor head of FIG. 11.

With reference to FIG. 12, the lower portion of the sensor head 200 is shown and in particular the positions of the first air vent 220, the sensor 208, and the second air vent 222.

Figure 13:
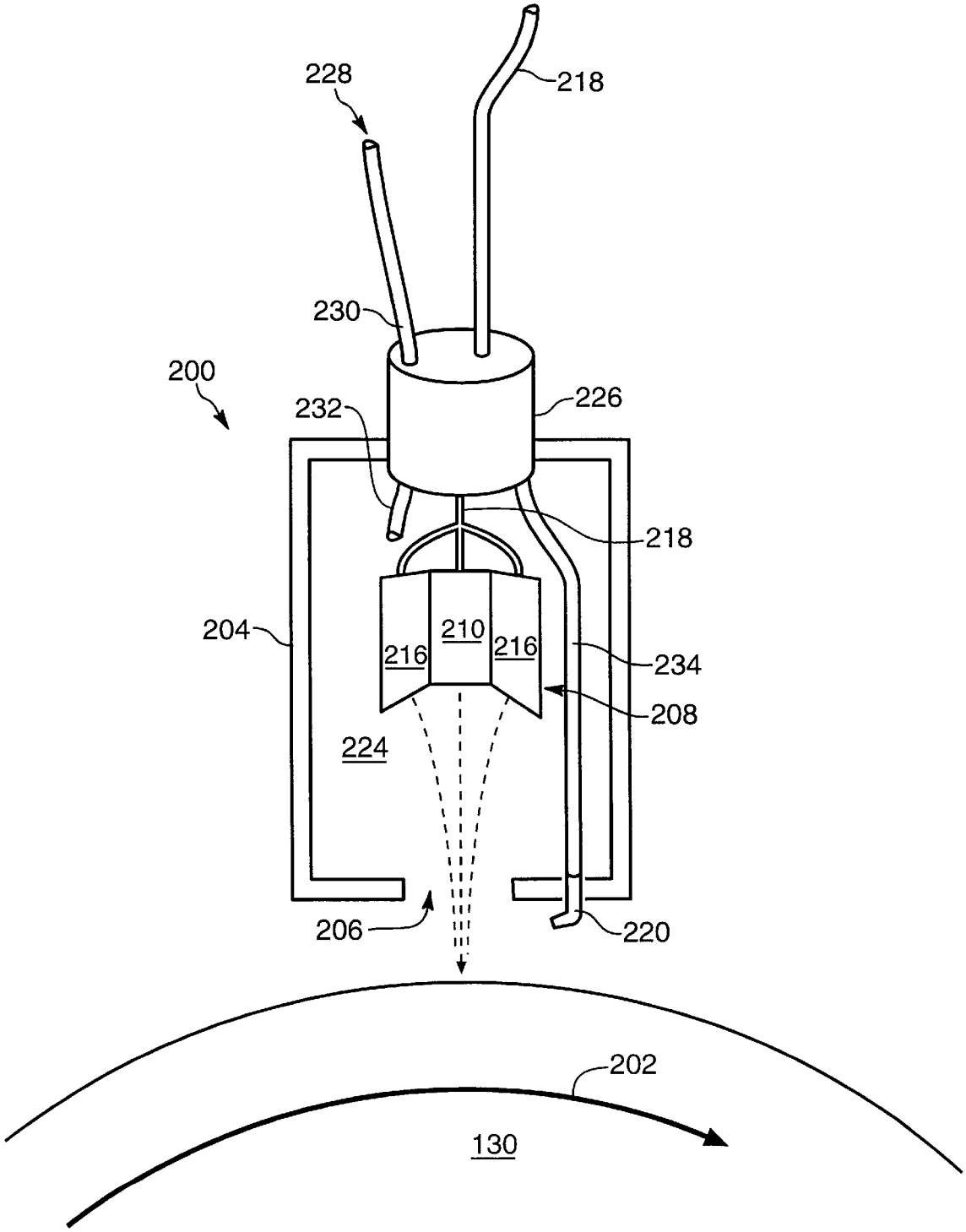
FIG. 13 is a cut-away side view of another alternative embodiment of the sensor head.

With reference to FIG. 13, a side view of an alternative embodiment of the sensor head 200 is shown. The sensor head 200 is configured with a sensor head housing 204 and an aperture 206 as in the embodiment of FIG. 11. The sensor 208 comprises a light source 210 which is disposed within the positive pressure chamber 224. The light source 210 emits a light to perform measurements as in the embodiment of FIG. 11, but no fiber optics are used for delivery. The emitted beam of light is directed toward the workpiece 130 through the aperture 206.

The sensor 208 further comprises at least one detector 216 which is disposed within the positive pressure chamber 224. The detector 216 may be positioned in various locations within the positive pressure chamber 224. In the embodiment of FIG. 13, two detectors 216 are used and placed adjacent to the light source 210. The detectors 216 receive scattered and reflected light from the surface of the workpiece 130 and generate a signal indicative of the proximity of the workpiece 130. The light source 210 and the detectors 216 are in electrical communication with the sensor lead 218 to provide delivery of power and generated signals.

In the embodiment of FIG. 13, an air supply 228 provides air through the inlet hose 230 to the air inlet 226. From the air inlet 226 the air is delivered to an outlet hose 232 and to a vent hose 234. The outlet hose 232 provides air to the positive pressure chamber 224. The vent hose 234 provides pressurized air to the first vent 220. In an alternative embodiment, delivery of air to the positive pressure chamber 224 and the first vent 220 may be as illustrated in FIG. 11. The embodiment of FIG. 13 does not incorporate a second vent 222. However, this feature may be incorporated if additional venting is desired.

The aperture 206 provides a positive flow of pressurized air from the positive pressure chamber 224 to the workpiece 130 to clear working fluids and debris. This is advantageous as the path of the light beam is directly through the aperture. Thus, a maximum flow of air is concentrated at the location of the measurement.

The sensor head 200 of either the embodiments of FIG. 11 or 13 is mountable on a sensor arm 50 such as that previously disclosed and discussed herein in the embodiments of FIGS. 3 and 4. The sensor arm 50 provides movement of the sensor head 200 in radial and tangential (z and y axis) directions relative to the workpiece 130. In this manner, the sensor arm 50 allows for positioning of the sensor head 200 for measurements. One of skill in the art will appreciate that other conventional arm members may also be used for the sensor arm 50. Furthermore, the sensor arm 50 may also be configured and designed to provide for movement of the sensor head 200 along the longitudinal or x-axis of the workpiece 130 independent of movement of the grinding machine 122 along the x-axis.

A computer 136, such as previously disclosed, predetermines coordinate signals and relays the signals to the sensor arm 50 to control movement of the sensor arm 50 on the y and z axis and to send the sensor arm 50 to a specific coordinate. The computer 136 is thus aware of the location of the sensor arm 50 and the sensor head 200. In the sensor arm embodiment of FIGS. 3 and 4, this is accomplished by electrical communication with the rotary encoders 58, 82 to control distances moved along the y and z axis through use of the servo motors 56, 80. In an alternative embodiment of the sensor arm 50, the sensor arm 50 does not comprise rotary encoders 58, 82. Rather, the sensor arm 50 comprises stepper motors and the computer 136 commands the stepper motors to direct the sensor arm 50 to a predetermined location.

The computer 136 predetermines the position of the sensor arm 50 and relays signals indicative of these coordinates directly to the stepper motors 56, 80. The stepper motors 56, 80 then move the sensor head 10 accordingly. One of skill in the art will appreciate that various other methods of achieving linear motion may be incorporated into the sensor arm 10 and are included within the scope of the invention.

Figure 14:
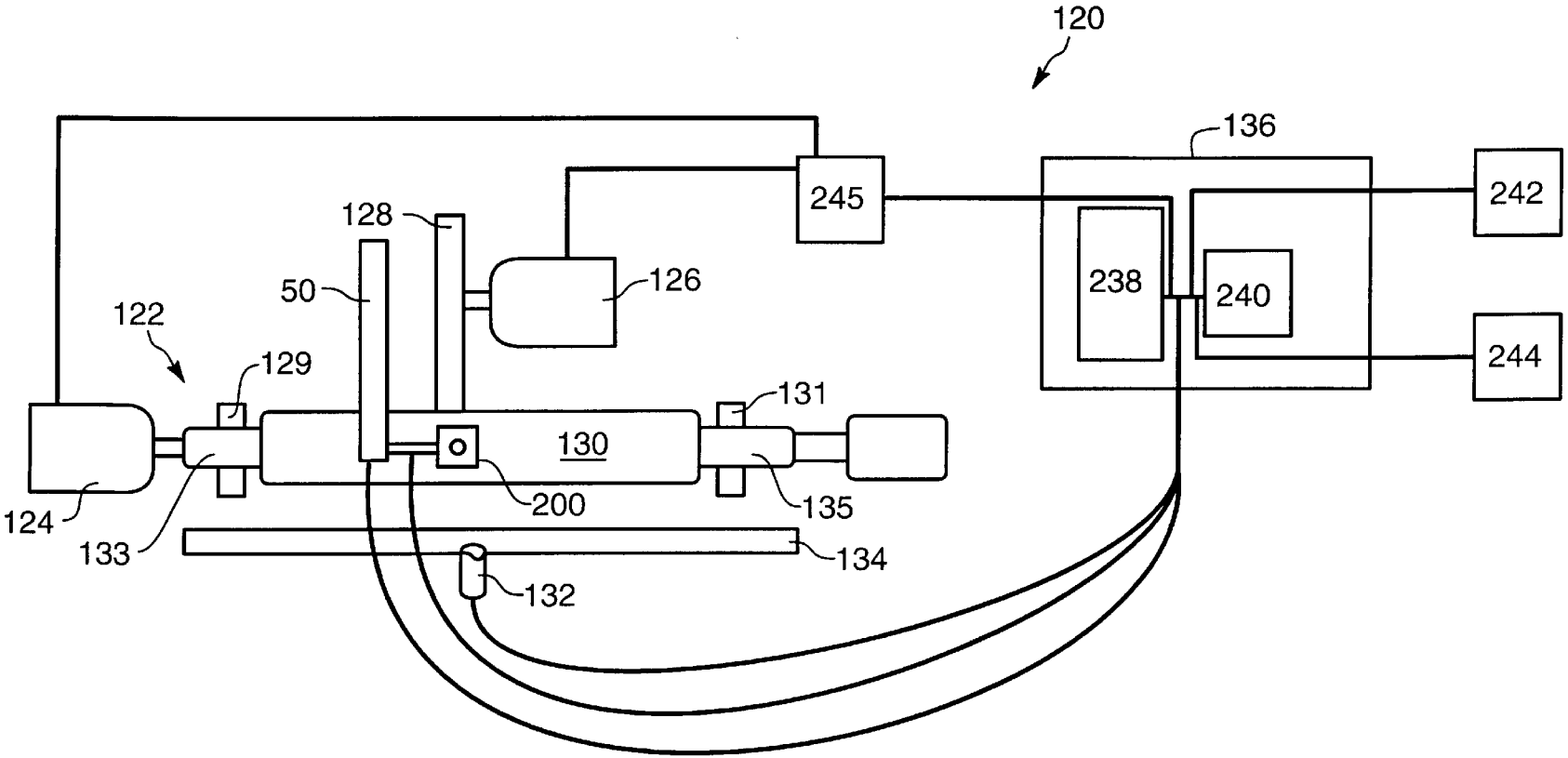
FIG. 14 is a block diagram of the gauging apparatus of the present invention in conjunction with the grinding machine.

With reference to FIG. 14, a conventional roll grinding machine 122 is shown with the sensor head 200 of the embodiment of FIG. 11. The roll grinding machine 122 is typical of the devices which can be monitored by use of the gauging apparatus of the present invention. Motor 124 controls rotation of the workpiece 130 and motor 126 controls operation of the grinding wheel 128. In the application shown in FIG. 14, the gauging apparatus 120 is used to monitor the grinding of a workpiece 130 while grinding is in process to increase the frequency, accuracy and reliability of the measurements of the workpiece 130.

Further shown in FIG. 14 is a rotary encoder 132 for detecting movement along the x-axis. The rotary encoder 132 engages a rack 134 to allow the gauging apparatus 120 to determine location along the x-axis of the workpiece 130. Although a rotary encoder 132 is provided in the illustrated embodiment, any device which provides information pertaining to location along the longitudinal axis of the workpiece 130 or x-axis may be used. Various devices are known in the art and will be reference herein as a longitudinal axis detector.

The computer 136 is in electrical communication with the sensor head 200, the sensor arm 50, and the longitudinal axis detector 132. With the sensor arm 50 having the embodiment of FIGS. 1 and 2, the computer 136 is in electrical communication with the rotary encoders 58, 82 to determine the position of the sensor arm 50. The computer 136 is thus able to determine the location of the workpiece 130 along the longitudinal axis of the workpiece 130 and the linear positioning of the sensor 208.

The computer 136 is equipped with a processor 238 which is suitable for performing the functions of the invention. The computer 136 further comprises a memory 240 in electrical communication with the processor 238. The memory 240 may comprise a read only memory (ROM), random access memory (RAM), and a non-volatile memory.

The computer 236 is in electrical communication with an output device 242 for displaying information relating to the measuring process and machining process. The output device 242 may be a monitor, printer, voice box, or any other device known in the art. Data being relayed to and from the sensor arm 50, sensor head 200, and the longitudinal axis device 234 may be displayed on the output device 242. The output device 242 further displays dimensions of the workpiece 130 as calculated by the computer 136 based on the input information received from the sensor head 200. The output device 242 further displays data inputted by the user. In one presently preferred embodiment, the output device 242 is embodied as a single computer monitor with suitable programming to allow switching between images, or with suitable programming to allow simultaneous viewing of windows showing the inputted data and calculated data. In one embodiment, the display may be as that shown in FIG. 7. Such display technology is well known in the art.

The computer 136 is further in electrical communication with an input device 244 to allow a user to input commands, preliminary dimensions of the workpiece 130, target dimensions for the workpiece 130, and other related information.

In one presently preferred embodiment, the computer 136 is in electrical communication with a grinding machine controller 245. The grinding machine controller 245 controls and effects all aspects of motor control of the grinding machine 122. Accordingly, the grinding machine controller 245 is in electrical communication with motors 124, 126 to control rotation of the workpiece 130 and application of the grinding wheel 128. The grinding machine controller 245 further determines movement of the grinding machine 122 along the longitudinal axis of the workpiece 130.

Functions performed by the gauging apparatus 120 incorporating the sensor head 200 in conjunction with the grinding machine 122 are now described. The workpiece 130 is assumed to be positioned in the grinding machine 122 and supported on the journal rests 129, 131.

One function of the sensor head 200 is to perform proximity measurements to position the workpiece 130 a certain distance from the zenith of the workpiece 130. This is necessary in order to perform dimensional measurements of the workpiece 130 which is described below.

In one process, the user may input into the computer 136 the dimensions of the workpiece 130, such as the length and the diameter. This allows the computer 136 to compute an estimated position for the sensor arm 50 and the sensor 208 along the y-axis and z-axis to position the sensor head 200 a desired length from the theoretical zenith of the upper surface of the workpiece 130. Thus, if the diameter of the workpiece 130 is 20", then an approximate starting distance may be 12" above the center of the workpiece 130. The sensor 208 is then moved to this position at a certain location along the x-axis adjacent to the workpiece 130. With the sensor 208 approximately placed above the workpiece 130, a proximity measurement is taken to determine the distance between the sensor 208 and the workpiece 130.

Figures 15A, 15B, 15C:
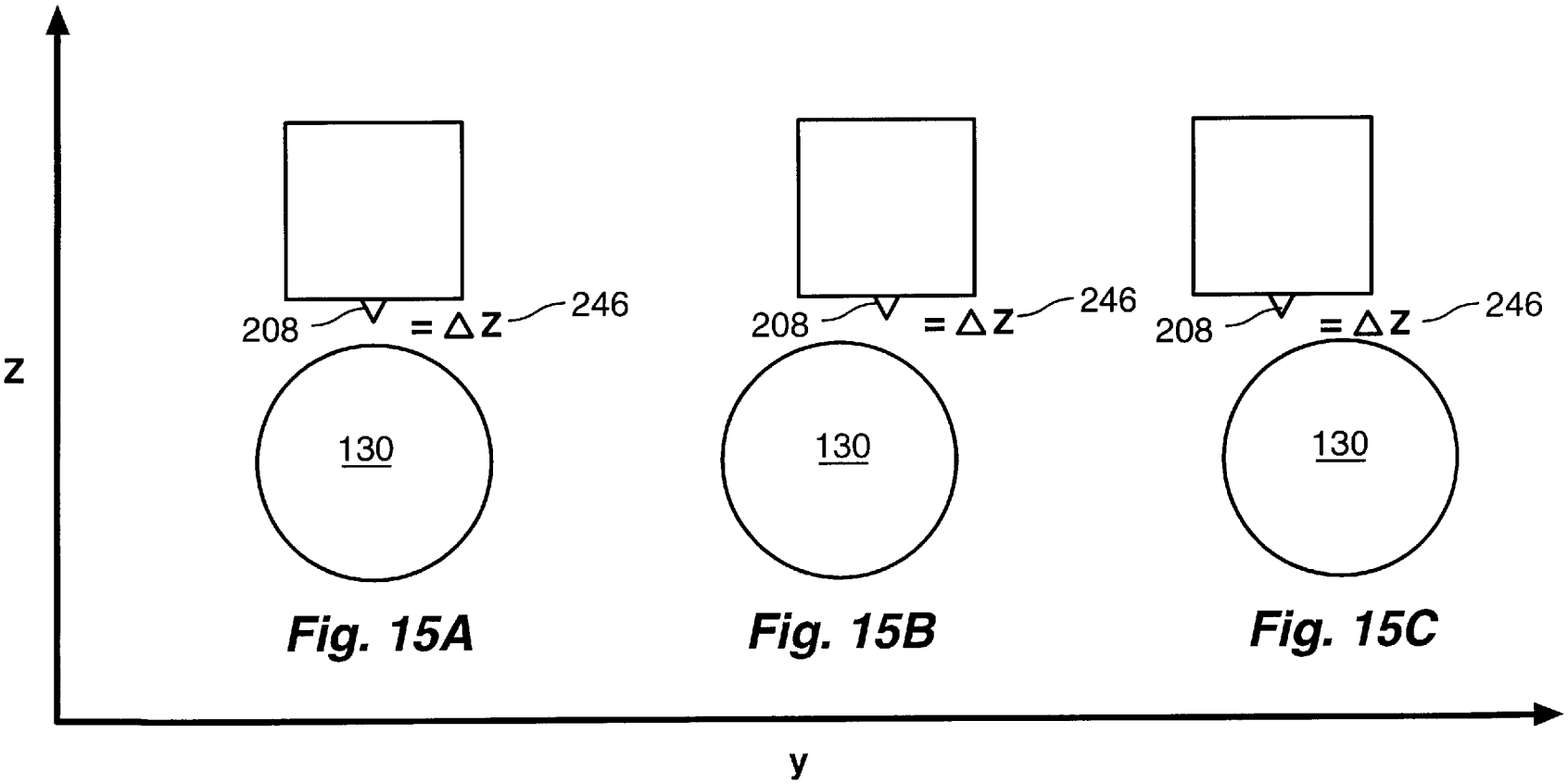
FIGS. 15A, B, and C are side views of the sensor head of FIG. 11, in each of a series of three sequential positions used in determining the zenith of a workpiece.

With reference to FIGS. 15A, B, and C, several measurements may be taken along the y-axis to ensure that the sensor 208 is positioned above the zenith. This is done by measuring the delta z 246 which is the distance from the sensor 208 to the workpiece 130. The delta z measurement is made at different locations along the y-axis. As shown in FIG. 15A, the sensor 208 is approximately above the zenith, and measuring at this point produces a z value 246. As shown in FIG. 15B, moving the sensor 208 a calculated distance in the +y direction yields a greater z value 246 than that of FIG. 15A. Likewise, as shown in FIG. 15C, moving the sensor 208 to a calculated distance in the −y direction yields a greater z value 246 than that of FIG. 15A. This process of remeasuring and moving the sensor 208 in the ±y direction may be repeated as necessary to locate the higher surface and zenith of the workpiece 130. In this manner, the zenith may be located using a single sensor 208. Once location of the zenith is determined, the computer maintains this value in memory for reference for future measurements.

It is advantageous to provide the computer 136 with the dimensions of the workpiece 130 in order to speed proximity measurements and location of the zenith. Nevertheless, the gauging apparatus is capable of locating the zenith of the workpiece 130 by repeating the above described process until the results have been achieved.

The process of proximity measurement to locate the zenith may be performed with a non-contact sensor, such as a light sensor, or with a contact gauge. A non-contact gauge is advantageous in that it reduces wear on the workpiece 130, is faster, more accurate, and more reliable.

Once the sensor 208 is placed above the zenith, the sensor 208 is moved to a predetermined distance from the workpiece 130. In one process, the distance from the zenith of the workpiece 130 is approximately 1.00".

Figure 16:
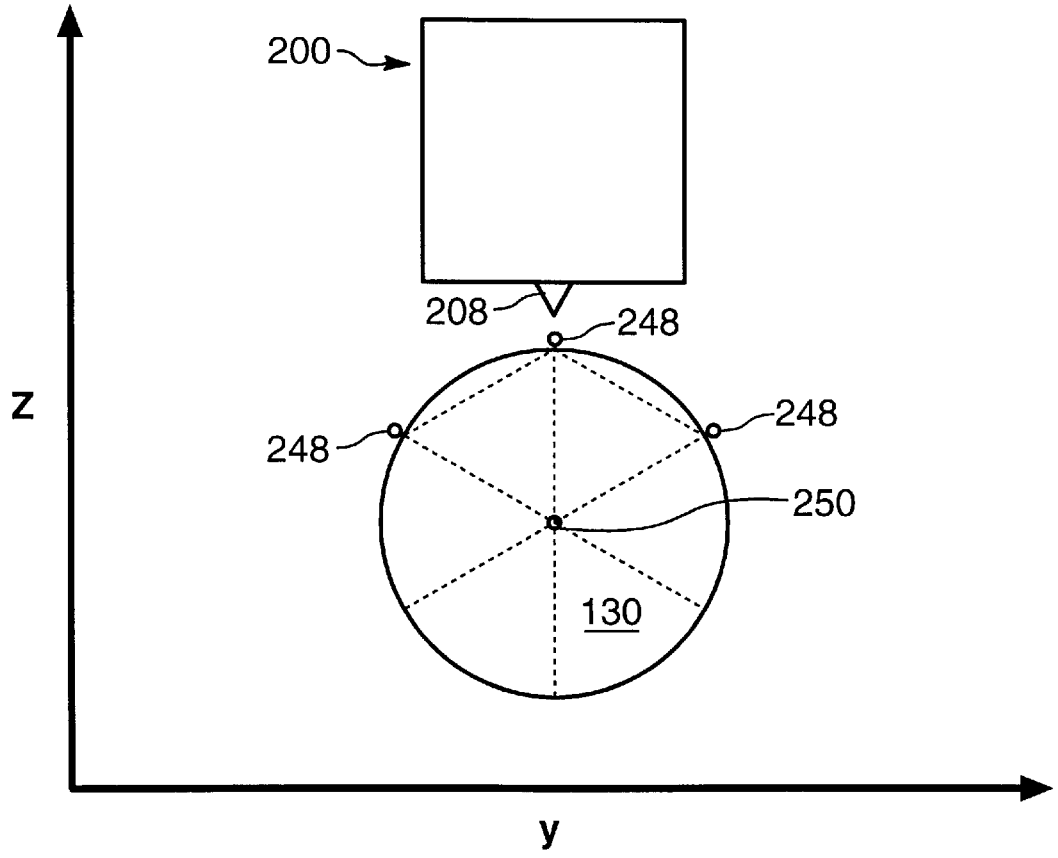
FIG. 16 is a side view of the sensor head of FIG. 11 in position over the workpiece to perform dimensional measurements.

With reference to FIG. 16, a process for taking dimensional measurements of the workpiece 130 is shown. The sensor 208 is above the zenith of the workpiece at the predetermined distance from the surface of the workpiece 130. The sensor 208 takes a proximity measurement at the zenith and at other locations along the y-axis on the surface of the workpiece 130 in order to allow the computer 136 to determine the center, radius, and diameter of the workpiece 130.

Calculation of the dimensions of the workpiece 130 based on proximity measurements of the surface may be done by various methods. In one presently preferred embodiment, at least three proximity measurements of the exterior curve of the workpiece 130 are made at indicated locations 248; one such location being the zenith. The computer 136 assumes and approximates a circle which will "fit" to the given locations 248. This method is herein referenced as computing a "curve fit" of the workpiece 130. Based on the curve fit the computer 136 is able to determine the center 250 based on geometric principles. Once the center 250 is determined, the radius and diameter of the workpiece 130 at this point on the x-axis are readily determined. This illustrates one process for determining dimensions of a workpiece 130 using a single sensor 208. One of skill in the art will appreciate that other methods of determining dimensions based on surface measurements are possible and are included within the scope of the invention.

The gauging apparatus repeats the dimensional measurements of the workpiece along the x-axis at intervals to determine a profile for the workpiece 130. In this manner, the gauging apparatus is capable of determining diameters along the entire longitudinal length of the workpiece 130 and can locate crowns and concavities as well as "sag" in the workpiece 130. A resulting profile of the workpiece 130 provides reliable information as to the form of the workpiece 130. By performing a multiplicity of testing, the gauging apparatus is further capable of measuring and computing the concentricity and roundness of the workpiece 130.

The dimensions of the workpiece 130 may be measured as the workpiece 130 is rotated and while the workpiece 130 is machined. This allows a user or computer 136 to adjust the grinding process in response to the current dimensions. The gauging apparatus enables in process measurements to analyze and to determine how much material needs to be removed to reach target dimensions. The sensor head 200 gauge gives feedback in order to adjust control of the machining.

The computer 136 sends signals to the grinding machine controller 245 to indicate necessary adjustments in the machining to achieve the desired results. By computer 136 management of the grinding machine 102 and the x-axis movement of the workpiece 130, the computer 136 can effect grinding of the entire workpiece 130 to targeted, desired results. Computer management allows grinding of the workpiece 130 until desired diameters at longitudinal positions are created on the workpiece 130. Thus, the gauging apparatus can achieve placement of a crown or a concave as desired on the workpiece 130.

Computer management of the grinding machine 102 also allows for the computer 136 to adust for the wear of the grinder wheel 128. In order to maintain a consistent speed during machining, the computer 136 needs to adjust the spindle speed and RPMs of the grinder wheel 128. The grinding machine controller 245 generates signals to the computer 136 indicative of the grinder wheel wear based on signals received from the motor 124. The computer 136 receives these signals from the grinding machine controller 245 and compensates for wheel wear.

If computer 136 control of the grinding machine 122 is not incorporated into the invention, the user may effect control of the grinding machine 122 manually to achieve the targeted results. The user may be instructed by the computer 136 through the output device 242 as to the current dimensions of the workpiece 130. The output device 242 may also display the target dimensions and recommended adjustments to the workpiece 130 to achieve the target dimensions.

The gauging apparatus of the present invention is further capable of measuring the alignment of the workpiece 130 in the grinding machine 122. This is done by measuring the proximity of the workpiece 130 at opposing ends of the workpiece 130 to obtain z values corresponding to the ends. Based on the z values, the vertical slope of the workpiece 130 as it rests in the grinding machine 122 may be determined. Similarly, the proximity of the workpiece 130 may be measured at opposing ends to find different y values. Based on the y values, the parallel alignment of the workpiece 130 relative to the grinding machine may be determined. Once the slopes have been determined, the workpiece 130 may be appropriately aligned to achieve a zero slope. In practice, the workpiece 130 is attached to journals at precise centers on both ends. It is preferable to measure alignment on the journals because it is from the journals that the workpiece 130 rotates.

The gauging apparatus is capable of measuring the sag or bend in a workpiece 130. This is done by measuring the stationary workpiece 130 at both ends and at the middle. The workpiece 130 is then rotated 180 degrees and the process is repeated. A comparison of these measurements allows the computer 136 to determine the sag in a workpiece 130.

In an embodiment incorporating a light sensor, the sensor 208 is further capable of measuring the roughness or as defined herein the "microroughness" of the surface of the workpiece 130. This measurement may be performed simultaneously with the dimensional measurements during the machining process. At the same time the sensor 208 measures the scattered light to determine the proximity of the surface, the intensity of the scattered light may be used to determine relative surface roughness. The computer 136 receives the signals indicative of the intensity of the scattered light and processes these signals not only to measure proximity, but also to compute the relative finish of the workpiece 130. Methods for computing surface roughness based on scattered light are known in the art.

The steps performed in machining a workpiece 130 in accordance with the gauging apparatus of the invention are now explained. The workpiece 130 is positioned in the grinding machine 102. Alignment measurements are then performed by the gauging apparatus as described above to ensure that the alignment of the workpiece 130 is true to the grinding machine 102.

Next the gauging apparatus performs proximity measurements to establish the location of the zenith of the workpiece 130 and to place the sensor 208 at an established distance from the zenith.

The gauging apparatus performs preliminary measurements to determine the dimensions and the condition of the workpiece 130. If the workpiece 130 was previously gauged on the gauging apparatus, then the dimensions and condition of the workpiece 130 may have been archived in memory 240. The dimensions of the workpiece 130 may be compared with the archived dimensions to determine the wear rate. Archiving the dimensions of a workpiece 130 allows traceability to give a complete history of the workpiece 130 which is useful for reprocessing of workpieces 130.

The desired target dimensions for the workpiece 130 are established and entered into the computer 136 by the user through the input device 244. The target dimensions remain resident in the memory 240 to allow the computer 136 to compare the current dimensions with the target dimensions during machining.

The grinding machine 122 commences machining of the workpiece 130 while the gauging apparatus performs in process measurements of the workpiece 130. During in process gauging, the gauging apparatus can determine if the target dimensions are achieved and the computer 136 can generate signals to indicate the necessary adjustments needed to achieve the target dimensions. The sensor 208 detects how much material is being removed from the workpiece 130 as the workpiece surface is reduced during the grinding process. Continuous measurements and processing allows the computer 136 to be aware during the machining process of the diameter of the workpiece 130 and the profile of the workpiece 130.

In the embodiment where a non-contact sensor is incorporated as the sensor 208, all gauging is achieved without ever touching the workpiece 130. A non-contact sensor further is capable of measuring the microroughness of the surface of the workpiece 130 before, during, and after the machining process.

In one presently preferred embodiment the computer 136 manages control of the gauging apparatus and the grinding machine 122 to receive feedback and effect adjustments to achieve the desired results. The computer 136 controls the grinding process to produce a workpiece 130 with the desired diameter, roundness, and concentricity. Furthermore, the computer controlled process allows reliable configurations of crowns and concaves in the workpiece 130. This reduces the necessary skill level of operation to allow a user to do the machining faster, with less expense, and with greater accuracy.

In an alternative embodiment, control of the grinding machine 122 may be human controlled. In such an embodiment, a user reviews the current dimensions of the workpiece 130 by means of the output device 242 during the machining process. The computer 136 may also display on the output device 242 recommended or necessary adjustments to the user. Based on this information the user then controls the grinding machine 102 to machine the workpiece 130 until the targeted dimensions are achieved.

Upon completion of the machining process, the final profile of the workpiece 130 is stored in the memory 240 or to another suitable memory storage. A hard copy of the workpiece 130 profile may be printed on a printer along with any other pertinent information. The hard copy could be secured to the workpiece 130 to allow future users immediate access to information about the workpiece 130. Furthermore, the computer 136 may be in electrical communication with a network of computers. In a network, the workpiece 130 profile may be stored in a network file to allow access to the workpiece 130 profile by other computer terminals on the network. In many instances, a hard copy, memory storage, and network storage will all be used to store a record of the workpiece 130 profile. These options in storage facilitate tracking of the workpiece 130 profile and adherence to quality control systems such as ISO 9001 and Statistical Process Control.

The computer 136 creates an identifier for the workpiece 130 and stores the final profile of the workpiece 130 in association with the identifier for future reference. A user may enter an identifier, such as a serial number, into the computer 136 and the computer 136 will access the memory 240 and return with the current dimensions of the identified workpiece 130. All workpieces 130 by the gauging apparatus may have their dimensions stored in this manner. The computer 136 may also return with a history of the workpiece 130 showing the dimensions of the workpiece 130 over time. This may be useful in determining a pattern of wear rate. A comparison of the last recorded dimensions may also be made with the current dimensions of the workpiece 130 to determine specifically how much wear has occurred.

In accordance with the system and process of the invention, measuring of a workpiece 130 may be performed before, during, and after machining without removing the workpiece 130 from the grinding machine 122. The setup time and aligning process of the workpiece is reduced substantially. A highly accurate profile of the workpiece 130 may be determined in less time and may be accomplished with a user with less experience. A historical summary of dimensions, crown, diameter, etc. of the workpiece 130 are maintained in memory for retrieval as needed. The workpieces 130 produced in accordance with the invention will be more consistent in shape which allows for easier compliance with quality standards. The archive allows historical tracing of workpieces 130 which provides a much needed missing link in modern quality control systems.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention.

What is claimed is:

1. A sensor head apparatus for dimensional measurement of a workpiece rotated about a longitudinal axis before, during, and after machining of the workpiece, comprising:

a sensor head housing configured with an interior cavity connected to an aperture;

a light sensor disposed at least partially within the interior cavity and including, a light source for producing a light which passes through the aperture to contact a surface of the workpiece, and a detector for sensing a portion of the reflected light passing through the aperture from the workpiece, wherein the detector generates a signal indicative of the proximity of the workpiece.

2. The sensor head apparatus of claim 1 wherein the light sensor comprises a laser light diode.

3. The sensor head apparatus of claim 1 further comprising a vent adjacent to the light sensor and configured to vent air to clear working fluids and debris from between the light sensor and the surface of the workpiece.

4. The sensor head apparatus of claim 3 further comprising a second vent adjacent the light sensor and configured to vent air for clearing working fluids and debris from the workpiece, and wherein the first vent is configured to vent air in a direction opposing the rotation of the workpiece.

5. The sensor head apparatus of claim 1 comprising only one light sensor.

6. The sensor head apparatus of claim 1 wherein the interior cavity maintains a positive pressure of air to thereby create a positive pressure chamber.

7. The sensor head apparatus of claim 6 wherein the light sensor is entirely contained within the interior cavity and the interior cavity provides positive pressure to the aperture to enable a positive and consistent air flow from the aperture.

8. The sensor head apparatus of claim 6 wherein the interior cavity provides positive pressure to the vent to enable a positive and consistent air flow from the vent.

9. The sensor head apparatus of claim 1 further comprising a computer in electrical communication with the light sensor for controlling and receiving input signals from the light sensor, wherein, based on the input signals, the computer determines the relative position of the sensor head to the workpiece, the proximity of the light sensor to the work piece, and the dimensions of the workpiece.

10. The sensor head apparatus of claim 9 wherein the computer compares current dimensions of the workpiece during the machining of the workpiece with target dimensions for the workpiece, and wherein the computer generates a signal indicative of necessary adjustments to achieve the target dimensions.

11. The sensor head apparatus of claim 9 wherein the computer is in electrical communication with the sensor head arm for directing movement of the sensor head arm to coordinates established by the computer.

12. The sensor head apparatus of claim 1 wherein the detector generates a signal indicative of the proximity of the surface of the workpiece based on the intensity and position of the portion of the reflected light.

13. The sensor head apparatus of claim 1 wherein the detector of the light sensor senses a portion of the reflected light from the workpiece and generates a signal indicative of the roughness of the surface of the workpiece.

14. The sensor head apparatus of claim 1 further comprising a sensor head arm connected to the sensor head for moving the sensor head in radial and tangential directions relative to the workpiece.

15. A gauging apparatus for dimensional measurement of a rotating workpiece to be used in conjunction with a grinding machine before, during, and after machining of the workpiece, comprising:

a sensor head having, a sensor head housing, a sensor disposed at least partially within the sensor head housing and configured to determine the proximity of a surface of the workpiece, and a sensor head arm, connected to the sensor head, for moving the sensor head in radial and tangential directions relative to the workpiece;

a longitudinal axis detector to generate signals indicative of the magnitude of movements in the longitudinal axial direction of the workpiece; and a computer in electrical communication with the sensor, sensor head arm, and the longitudinal axis detector for generating control signals and receiving input signals, wherein, based on the control signals and the input signals, the computer determines the relative position of the sensor head to the workpiece, the proximity of the sensor to the workpiece, and a dimension of the workpiece.

16. The gauging apparatus of claim 15 wherein the sensor comprises a light sensor, including, a light source for producing a light to contact the workpiece, and a detector for sensing a portion of the reflected light from the workpiece to determine the intensity and position of the portion of the reflected light and for generating a signal indicative of the proximity of the workpiece.

17. The sensor head apparatus of claim 16 wherein the detector of the light sensor senses a portion of the reflected light from the workpiece and generates a signal indicative of the roughness of the surface of the workpiece.

18. The gauging apparatus of claim 15 wherein the sensor is a contact gauge configured to perform proximity measurements with the workpiece.

19. The gauging apparatus of claim 15 further comprising an input device in electrical communication with the computer for entering an approximate dimension of the workpiece and a target dimension for the workpiece.

20. The gauging apparatus of claim 15 wherein the computer comprises a memory and wherein the computer stores in memory a dimension of an identified workpiece.

21. The gauging apparatus of claim 20 wherein the computer retrieves from memory a dimension of an identified workpiece and compares the retrieved dimension with a current dimension.

22. The gauging apparatus of claim 15 further comprising a vent disposed on the sensor head housing and configured to vent air to clear working fluids and debris from between the sensor and the surface of the workpiece.

23. The gauging apparatus of claim 22 further comprising a positive pressure chamber defined in part by the sensor head housing.

24. The gauging apparatus of claim 23 wherein the positive pressure chamber is connected to the vent to provide a positive and consistent air flow to the vent.

25. The gauging apparatus of claim 22 further comprising a second vent adjacent the sensor and configured to vent air for clearing working fluids and debris from the workpiece, and wherein the first vent is configured to vent air in a direction opposing the rotation of the workpiece.

26. The gauging apparatus of claim 15 wherein the sensor head comprises only one sensor.

27. The gauging apparatus of claim 15 wherein the computer compares a current dimension of the workpiece during the machining of the workpiece and a target dimension of the workpiece, and wherein the computer generates a signal indicative of necessary adjustments to achieve the target dimension.

28. The gauging apparatus of claim 27 further comprising an output device in electrical communication with the computer for displaying the current dimension of the workpiece during the machining process.

29. The gauging apparatus of claim 27 further comprising a grinding machine controller in connection with the grinding machine to effect operation of the grinding machine, wherein the grinding machine controller is in electrical communication with the computer, wherein the grinding machine controller receives signals indicating necessary adjustments in the machining to achieve a target dimension.

30. The gauging apparatus of claim 15 wherein the computer relays signals to the sensor head arm for directing movement of the sensor head arm to coordinates established by the computer.

31. A gauging apparatus for dimensional measurement of a rotating workpiece to be used in conjunction with a grinding machine before, during, and after machining of the workpiece, comprising:

a sensor head having, a sensor head housing configured with a positive pressure chamber connected to an aperture, a light sensor disposed at least partially within the interior cavity and including, a light source for producing a light which passes through the aperture to contact a surface of the workpiece, and a detector for sensing a portion of the reflected light passing through the aperture from the workpiece, wherein the detector generates a signal indicative of the proximity of the workpiece;

a sensor head arm, connected to the sensor head, for moving the sensor head in radial and tangential directions relative to the workpiece;

a longitudinal axis detector capable of generating signals indicative of the magnitude of movements in the longitudinal axial direction of the workpiece; and a computer in electrical communication with the sensor, sensor head arm, and the longitudinal axis detector for generating control signals and receiving input signals, wherein, based on the control signals and the input signals, the computer determines the relative position of the sensor head to the workpiece, the proximity of the sensor to the workpiece, and a dimension of the workpiece, and wherein the computer relays signals to the sensor head arm for directing movement of the sensor head arm to coordinates established by the computer.

32. The sensor head apparatus of claim 31 wherein the detector of the light sensor senses a portion of the reflected light from the workpiece and generates a signal indicative of the roughness of the surface of the workpiece.

33. The sensor head apparatus of claim 31 wherein the light sensor is entirely contained within the positive pressure chamber and positive pressure chamber provides positive pressure to the aperture to enable a positive and consistent air flow from the aperture.

34. The gauging apparatus of claim 31 further comprising a vent disposed on the sensor head housing and configured to vent air to clear working fluids and debris from between the sensor and the surface of the workpiece.

35. A method for determining the dimensions of a workpiece before, during, and after the machining of the workpiece to produce a desired workpiece dimension, comprising the steps of:

positioning the workpiece in a grinding machine;

rotating the workpiece in the grinding machine along the longitudinal axis of the workpiece;

directing light from a single light source to the surface of the workpiece at a plurality of locations having substantially the same longitudinal position along the longitudinal axis of the workpiece;

measuring the intensity and position of the reflected light from the surface of the workpiece at the plurality of locations;

determining the proximity of the workpiece from the light source at the different locations based on the intensity and position of the reflected light;

computing the zenith of the workpiece based on the proximity of the workpiece from the light source at the different locations; and computing the diameter of the workpiece at a specific location along the longitudinal axis based on the proximity of the workpiece from the light source at the different locations.

36. The method of claim 35 further comprising the steps of:

comparing the diameter of the workpiece at a longitudinal position to a target diameter; and applying the grinding machine to the workpiece to achieve the target diameter.

37. The method of claim 35 further comprising the steps of:

directing light from the single light source to the surface of the workpiece at a plurality of locations having substantially different positions along the longitudinal axis of the workpiece;

measuring the intensity and position of the reflected light from the surface of the workpiece at the plurality of locations to determine the proximity of the workpiece from the light source; and computing the slope of the workpiece along the longitudinal axis of the workpiece relative to the single light source.

38. The method of claim 37 further comprising the step of adjusting the workpiece to eliminate slope along the longitudinal axis of the workpiece relative to single light source.

39. The method of claim 35 further comprising the step of computing the roughness of the surface of the workpiece based on the intensity of the reflected light.

40. The method of claim 35 further comprising the steps of:

directing light from the single light source to a plurality of locations along the longitudinal length of the workpiece;

determining the proximity of the workpiece from the light source at different locations based on the intensity and position of the reflected light;

computing diameters of the workpiece at different locations along the longitudinal axis based on the proximity of the workpiece from the light source at the different locations; and generating a workpiece profile based on the diameters of the workpiece.

41. The method of claim 40 further comprising the step of recording the resulting diameters and workpiece profile.

* * * * *

UNITED STATES PATENT AND TRADEMARK OFFICE

CERTIFICATE OF CORRECTION

PATENT NO. : 6,062,948
DATED : May 16, 2000
INVENTOR(S) : Tod F. Schiff et al.

It is certified that error appears in the above-identified patent and that said Letters Patent is hereby corrected as shown below:

In References Cited Section, please add the following United States Patents
-- 5,227,730 7/13/93 King et al. 324/632 --
-- 5,334,941 8/2/94 King 324/637 --
-- 5,359,418 10/25/94 Zaleski 356/387 --
-- 5,371,975 12/13/94 Lundmark 451/9 --
-- 5,563,808 10/8/96 Tuck et al. 364/560 --
-- 5,568,260 10/22/96 Schneiter 356/376 --

Signed and Sealed this

Eighteenth Day of September, 2001

*Attest:*

Nicholas P. Godici

*Attesting Officer*

NICHOLAS P. GODICI
*Acting Director of the United States Patent and Trademark Office*